US005771667A

United States Patent [19]

McGregor et al.

[11] Patent Number: 5,771,667

[45] Date of Patent: Jun. 30, 1998

[54] BAG FILLING, CLOSING, AND SEALING MACHINE

[75] Inventors: James R. McGregor, P.O. Box 710, Owatonna, Minn. 55060; Tracy J. Steiger; LaVern N. Wobschall, both of Owatonna, Minn.

[73] Assignee: James R. McGregor, Owatonna, Minn.

[21] Appl. No.: 744,628

[22] Filed: Nov. 6, 1996

[51] Int. Cl.[6] ..... B65B 1/06; B65B 7/06; B65B 51/14

[52] U.S. Cl. ..... 53/469; 53/481; 53/284.7; 53/374.5; 53/571

[58] Field of Search ..... 53/469, 481, 284.7, 53/571, 374.6, 374.5; 141/10, 114

[56] References Cited

U.S. PATENT DOCUMENTS

| | | | |
|---|---|---|---|
| 3,488,914 | 1/1970 | Csernak | 53/374.5 X |
| 3,488,915 | 1/1970 | Delestatius | 53/284.7 X |
| 3,656,274 | 4/1972 | Vind | 53/284.7 X |
| 3,889,449 | 6/1975 | Membrino | 53/284.7 X |
| 4,322,932 | 4/1982 | McGregor | 53/505 |
| 4,432,186 | 2/1984 | McGregor . | |
| 4,473,989 | 10/1984 | Tsutsumi et al. | 53/284.7 X |
| 4,526,214 | 7/1985 | McGregor | 141/59 |
| 4,612,965 | 9/1986 | McGregor | 141/114 |
| 4,706,441 | 11/1987 | Chervalier | 53/284.7 X |
| 4,884,389 | 12/1989 | McGregor | 53/571 |
| 5,191,920 | 3/1993 | McGregor | 141/313 |

*Primary Examiner*—Horace M. Culver
*Attorney, Agent, or Firm*—Moore & Hansen

[57] ABSTRACT

A fully automated apparatus and operating system for supplying, transferring, filling, and sealing bags, utilizing a clam shell type of filling spout is provided in combination with apparatus for sealing each filled bag in close proximity to the spout. The bag sealing apparatus incorporates heat sealing bars mounted on a carriage movable between a first position adjacent to the filling spout for receiving filled bags and sealing them, and a second position wherein filled and sealed bags are released. The same carriage supports clamping bars movable between open and closed positions to clamp a filled bag while it is still being held on the filling spout, and to support the bag, after removal from the spout, while the bag mouth is being sealed by the heat sealing bars. The machine also incorporates automatically controlled bag supply apparatus which functions to deliver bags into position to be picked up by a bag transfer assembly with clamps which grip the leading edge of each bag as it is supplied on a conveyor; and the transfer assembly is swingable to a position wherein it accurately places the mouth of a bag on the filling spout. The spout is pivotally movable between a first, bag receiving and fill commencing position, and a second, bag release position wherein a filled bag is properly located for engagement by the aforesaid clamping and sealing bars on the movable carriage.

19 Claims, 7 Drawing Sheets

1
24
22
26
98
12
2
14
28
96
13
186
46
44
34
30
94
32
178
36
40
52
38
42
92
70
84
78
180
172
185
60
184
48
64
50
68
58
56
62
54
66
90
80
72
86
82
170
114
102
74
103
188
169
168
99
120
108
140
144
100
106
109
101
76
136
142
156
164
74a
107
104
138
152
84
148
154
74a
74a
132
80
150
74b
74b
110
146
74
117
114
128
126
122

181

BAG FILLING, CLOSING, AND SEALING MACHINE

BACKGROUND OF THE INVENTION

This invention relates to bag handling and filling machines, and more particularly to such machines which are fully automated to pick up bags one at a time from a supply source, fill the bags, and release them in an integrated, high speed, and efficient system.

Machines of that type are known in the art. See, for example, U.S. Pat. Nos. 4,322,932, 4,432,186, and 4,612,965 issued to Harold R. McGregor. Traditionally, machines of the aforesaid type have utilized bag holding clamps on a clam shell type of filling spout to hold the bag during a filling operation on the spout, with the filled bag then being conveyed to a separate, closing machine for closing the bag top, as by stitching or by heat sealing. Bag control and forming bars have been incorporated to grip the bag mouth, after filling, and to lower it onto a conveyor, which serves to transport the filled bag to a separate, bag closing station. Such bag handling and control bars are shown, for example, in U.S. Pat. No. 4,322,932. Recognizing that operating efficiencies and more compact, reduced cost, bag handling systems could be realized by incorporating the bag sealing function within the basic, bag filling machine in the same general location as the filling spout, an improved bag handling, filling, and sealing machine incorporating that advantage has been developed, as disclosed herein.

BRIEF SUMMARY OF THE INVENTION

This invention has as its primary objective the manufacture of a machine for the automatic, high speed, integrated pick-up, filling, and sealing of bags, utilizing a filling spout incorporating bag holding and clamping means, in combination with bag sealing apparatus disposed in cooperative relation to the filling spout.

A further objective is to provide such a machine which is particularly adapted for the filling and sealing of plastic bags, either preformed or provided from roll stock in sheets. For that purpose, the bag sealing apparatus incorporates heat sealing bars mounted on a carriage which is movable between a first position in close proximity to the filling spout for receiving filled bags and sealing them, and a second position wherein filled and sealed bags are released for removal, as by a conveyor.

An additional objective is to incorporate the aforesaid features on a bag handling and filling machine having a filling spout movable between a first, bag receiving and clamping position, and a second, bag release position wherein the bag is positioned to be engaged by the aforesaid heat sealing bars. As a particularly advantageous feature, the filling of each bag commences in the first, bag receiving position of the filling spout, and the heat sealing is accomplished after the spout has swung to its second, bag release position.

Particular operating efficiencies are achieved by commencing the filling of each bag when the filling spout is in its first, bag receiving and clamping position and commencing the heat sealing of filled bags, in the top area of the bag mouth, when the spout is in its second, filled bag, release position in cooperative juxtaposition to the bag sealing carriage. Maximum bag filling and handling cycle time is achieved by coordinating the control and movements of the filling spout and the bag sealing carriage so that the filling spout is moving back to its first, bag receiving position as the heat sealing operation is being carried out, with the carriage moving through a path away from the spout.

A particularly advantageous feature utilized to carry out the aforesaid objectives resides in the provision of a pair of bag clamping bars on the same movable carriage on which the sealing apparatus is mounted. Preferably, the sealing apparatus comprises a pair of heat sealing bars movable between an open position, and a closed position in engagement with opposite faces of the bag mouth, after the bag has been filled. In the preferred embodiment, separate actuating means are provided to separately operate the heat sealing bars and the clamping bars so as to move both sets of bars between their open, and closed, bag engaging positions, at the desired times in a machine operating cycle.

For those applications where the top area of the bag to be sealed, on its mouth, would normally be clamped on the filling spout, during the bag filling operation, the aforesaid opening and closing movement of the bag clamping bars and the bag sealing bars is coordinated so that the clamping bars first grip the bag mouth while it is still on the spout, after which the carriage moves on its path away from the spout, before the heat sealing operation begins by the closing movement of the heat sealing bars.

In the preferred embodiment, the aforesaid objectives and bag filling and sealing operations are accomplished by providing a vertical track on which the aforesaid heat sealing carriage moves upwardly and downwardly in a vertical path between an elevated, bag receiving position, and a lowered, bag release position. Heat sealing may be carried out while the bag is being lowered on the downward travel of the carriage.

As a further beneficial feature, a stop mechanism is provided on the machine, so as to be movable between a first position to engage and stop a filled bag as it is swung by the spout from the spout's first, bag receiving and clamping position to the spout's second, bag release position. The swinging movement of a filled bag, caused by the movement of the spout, is thus controlled by this stop device so as to position the bag in a stabilized location in which the filled bag is hanging substantially vertically in proper alignment for engagement by the clamping and heat sealing bars on the movable carriage.

The aforesaid features are utilized in conjunction with an automatic bag supplying apparatus wherein bags are moved, one at a time, from a supply source and placed on a conveyor for movement into a pickup position. Automatically controlled, pivotal bag transfer arms are utilized to pick up the leading edge of a bag from the aforesaid bag pickup position, and to swing the bag up for placement on the filling spout and retention on the spout by the bag clamps on the spout. Bag movement is thus completely controlled in an automated, integrated system from the first movement of a bag from a supply source, through to the filling of the bag, the sealing of the bag mouth, and the movement of a filled bag to a release position by the aforesaid carriage.

These and other features, objects, and advantages of the invention will be readily understood as the following description is read in conjunction with the accompanying drawings, in which like reference numerals have been used to designate like elements throughout the se veral views.

DESCRIPTION OF THE PREFERRED EMBODIMENTS

Figure 1:
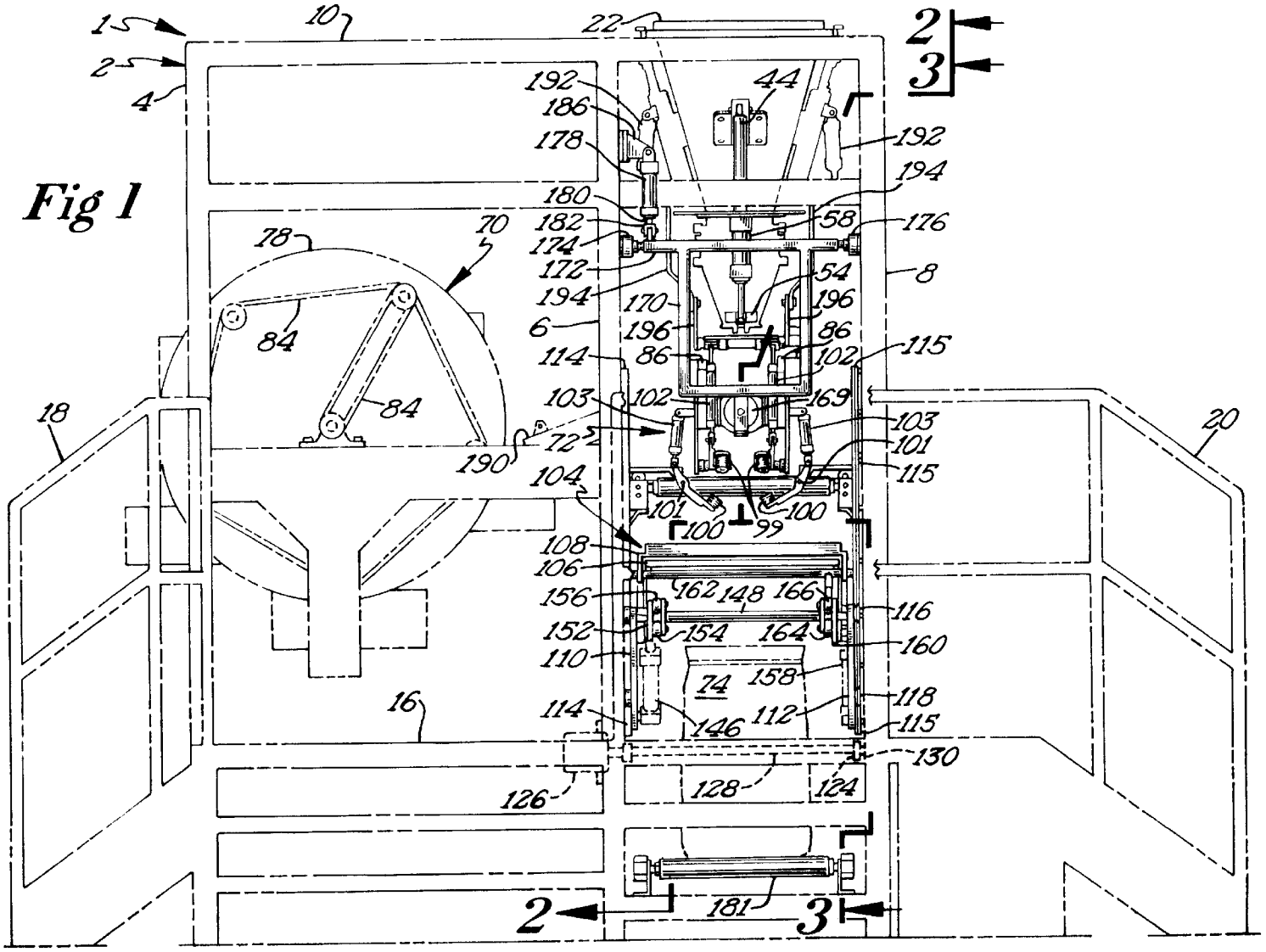
FIG. 1 is a front elevation view of the machine of this invention.
Figure 2:
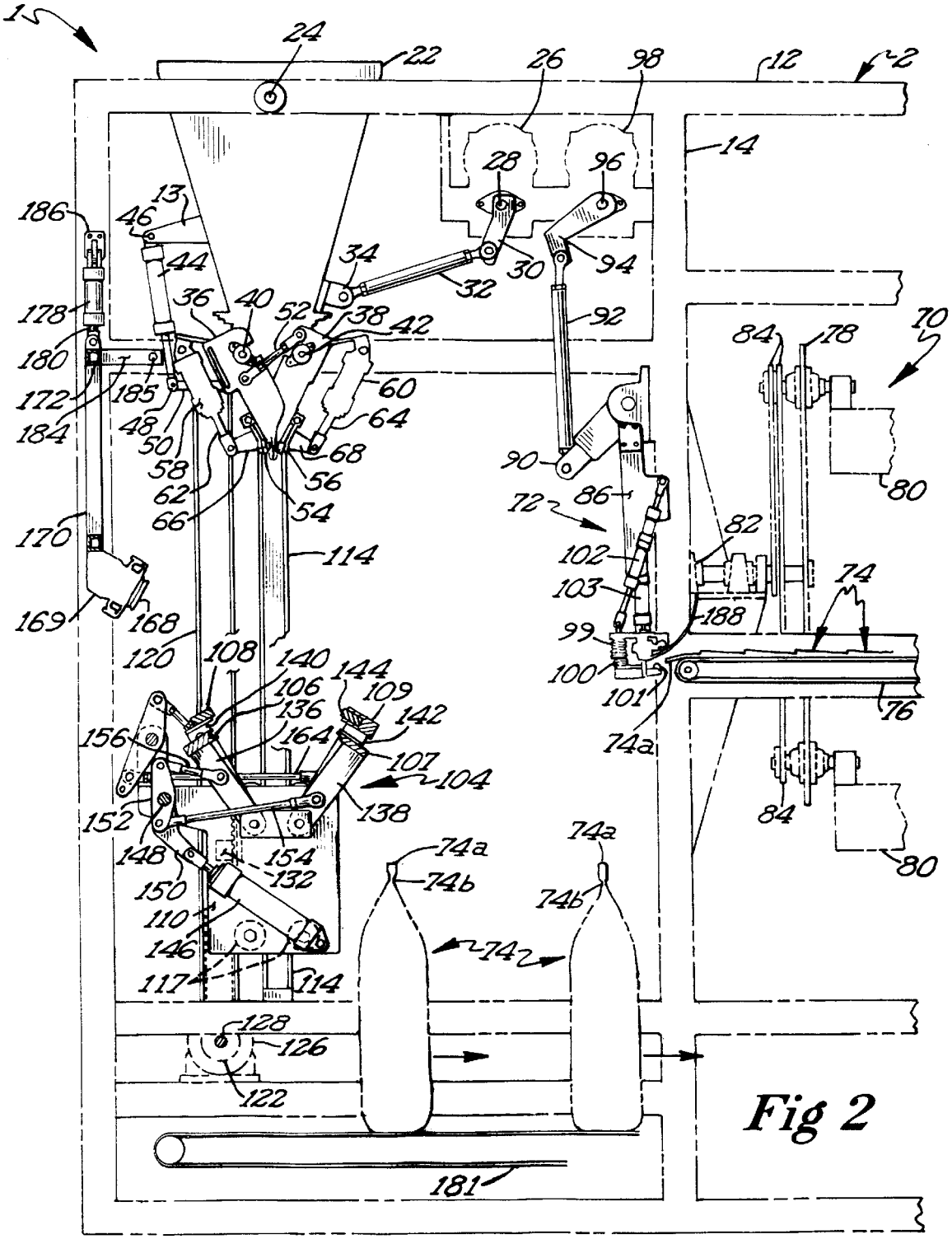
FIG. 2 is a side elevation view of the machine of FIG. 1, taken along lines 2—2 of FIG. 1.
Figure 3:
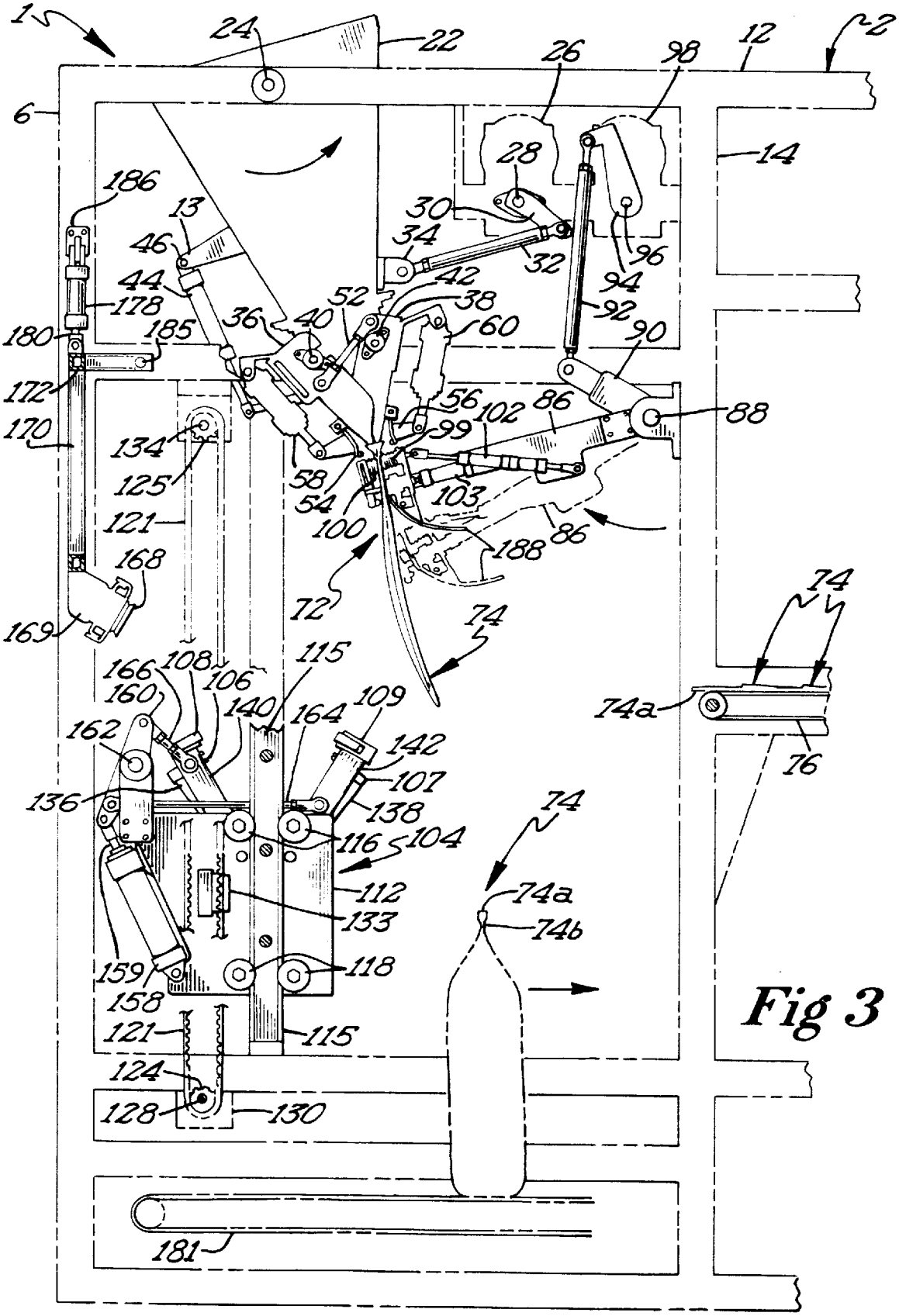
FIG. 3 is a side elevation view of the machine, but showing the machine components as viewed along lines 3—3 of FIG. 1, and showing the bag filling spout in its first, rearwardly pivoted position for receiving a bag.

FIGS. 1 and 2 show a machine incorporating an automatic bagging system having the fully controlled and coordinated bag handling, spout placement, filling, and sealing components and features of this invention. The machine is generally indicated by reference numeral 1, and is mounted on a frame assembly 2. The frame includes vertical and horizontal frame members, several of the vertical frame members being indicated by reference numerals 4, 6, and 8. Horizontal frame members 10 and 12 are also shown in FIGS. 1 and 2, along with vertical frame member 14 in FIG. 2. The frame supports an operator platform 16 with guard rails 18 and 20 as shown. FIG. 1 is a front view of the machine, which includes a material discharge spout 22 pivotally mounted on a pivot axis 24 (FIG. 2) for swinging movement between a first, bag receiving position, and a second, bag release position as hereinafter set forth. For that purpose, a fluid motor 26, preferably of the pneumatic type is provided at a location as shown on the frame assembly 2. Fluid motor 26 may be, for example, a double acting, air cylinder constructed and arranged to rotate an output shaft 28 having a crank 30 attached to it. Crank 30 is pivotally attached to a link bar 32 which is pivotally secured at its opposite end to a clevis 34 on spout 22. With this mechanical, power arrangement, spout 22 may be pivotally swung between a first, bag receiving position as shown in FIG. 3, and a second, bag release position as shown in FIG. 2.

Spout 2 is preferably of the clam shell type, and is comprised of a pair of clam shell halves 36 and 38 which are pivotal between open and closed positions about pivot pin connections 40 and 42 at the lower, discharge end of spout 22. Such a spout is normally attached at its upper end to a supply hopper (not shown) into which charges of particulate material are dispensed, as by a net weight scale, for filling bags one at a time with a desired quantity or weight of material. The spout and apparatus as disclosed are designed to be utilized for filling bags of the open mouth type with free flowing, particulate material, including feed, seeds, etc. It is contemplated that various materials may be effectively dispensed into bags and sealed by the machine as disclosed herein, including material such as pet food and cereals.

For the purpose of actuating the spout clam shell sections 36 and 38 between open, material dispensing positions and closed positions, a power cylinder 44 is preferably utilized. Double acting, fluid cylinder 44 is mounted on horizontal deck 13 of the frame assembly 2 by a bracket, as shown in FIG. 2, for support on a pivot pin 46. The piston 48 of cylinder 44 is pivotally attached to a link 50 connected to one of the clam shell sections 36. Such a clam shell spout assembly and its power cylinder actuator are disclosed in U.S. Pat. No. 4,322,932, particularly with reference to FIG. 4 thereof. As disclosed in that patent, the clam shell assembly further includes a connecting rod 52 extending between the upper ends of the two clam shell sections 36 and 38. With this arrangement, the pivotal movement of clam shell 36 by power cylinder 44 transmits pivotal movement to the second, clam shell section 38 by means of connecting rod 52. When piston 48 of cylinder 44 is retracted, clam shell sections 36 and 38 are moved to their open positions. As shown in FIG. 2, with piston 48 extended, the clam shell sections are closed, and no bag filling operation is taking place.

Also, as disclosed in U.S. Pat. No. 4,322,932, bag clamps 54 and 56 are provided on the bottom ends of clam shell sections 36 and 38 for clamping and holding the opposite sides of a bag mouth, on the spout. Such a spout clamp assembly and its manner of operation may be the same as that disclosed in U.S. Pat. No. 4,322,932, which is incorporated herein by reference. Accordingly, the spout clamps are not shown and disclosed in detail. They are actuated by double acting, power cylinders 58 and 60 having pistons 62 and 64 pivotally connected to the respective spout clamps by links 66 and 68. Thus, when pistons 58 and 60 are extended, the spout clamps 54 and 56 will be moved inwardly towards the spout clam shell sections 36 and 38 to clamp the opposite sides of the mouth of a bag therebetween.

As shown in FIG. 2, the machine also includes bag supply apparatus generally indicated by reference numeral 70. It is contemplated that various types of bag transporting and conveying mechanisms may be utilized to deliver bags one at a time in position to be picked up and placed on spout 22 by a transfer arm assembly generally indicated by reference numeral 72. Preferably, bags 74 are delivered in shingled fashion on a horizontal conveyor 76, as shown in FIG. 2. The bags will be made of plastic materials, and may be of the pinch bottom or flat bottom type, and either gusseted or not gusseted along their side walls. A supply magazine is provided, from which bags are delivered one at a time onto conveyor 76 in the shingled fashion as shown.

Various types of bag storing and supply magazines or apparatus may also be utilized. A carousel type of bag supply may be effectively utilized. Such a bag supply apparatus is disclosed in U.S. Pat. No. 4,884,389, the disclosure of which is incorporated herein by reference. Accordingly, the bag supply apparatus, preferably of the carousel type, will not be disclosed in detail. As therein disclosed, the carousel apparatus incorporates a rotatable mounting plate of circular configuration, on which a plurality of bag containing trays or magazines are mounted at circumferentially spaced locations. Such an apparatus is indicated generally by reference numeral 70, and includes such a rotatable mounting plate 78 on which a plurality of bag containing trays 80 are mounted and rotatably conveyed into bag delivery positions, intermittently. A drive motor 82 is utilized in conjunction with drive belts 84, as illustrated diagrammatically in FIG. 2, to controllably and intermittently rotate the carousel plate 78 so as to present one of the trays 80 with bags in a position to be picked up and placed on conveyor 76, one at a time. That drive arrangement is the same as disclosed in the aforesaid U.S. Pat. No. 4,884,389. Also, as disclosed in that patent, a swing arm carrying suction cups is preferably utilized to rotate between a bag pickup position above one of the magazines 80, and a bag delivery and release position for delivering a bag 74 onto conveyor 76. As stated above, various other types of bag delivery apparatus and mechanisms may be utilized to place bags intermittently, one at a time onto conveyor 76 for delivery to a bag pick up position by transfer arm assembly 72.

Transfer arm assembly 72 is of the same basic construction and operation as disclosed with respect to such a transfer arm assembly in U.S. Pat. No. 4,432,186, the disclosure of which is incorporated by reference. As disclosed in that patent, and particularly in the portion of the specification describing FIGS. 16, 17, and 21–23, a pair of transfer arms 86 are mounted for swinging movement about a pivot or crank shaft 88. Shaft 88 is rotated, reversibly, to raise and lower transfer arms 86 by a mechanical leakage including crank arms 90, longitudinally adjustable link bar 92, and crank arm 94. As shown in FIG. 2, crank arm 94 is mounted on the output or drive shaft 96 of a fluid motor 98 for reversible rotation. Like fluid motor 26, fluid motor 98 is preferably of the pneumatic type, and may comprise a double acting power cylinder connected to shaft 96 for controlled, intermittent, reversible rotation of that shaft.

Each of the transfer arms 86 has mounted at its bottom end a suction clamp device 100 movable between an open position as shown in FIG. 2, and a closed, bag engaging position for clamping the opposite ends, of the leading edge of a bag 74 as advanced on conveyor 76 to a bag pickup position. Clamps 100 comprise oppositely opposed suction cups, to which a vacuum source is connected, as described in the aforesaid U.S. Pat. No. 4,432,186. Such clamping devices insure positive, controlled clamping of the leading edge of each bag 74 advanced intermittently on conveyor 76. Suction clamps 100 are pivotally actuated between the open position shown in FIG. 2, and the closed, bag gripping position of FIG. 3 by double acting power cylinders 102. Those cylinders are also pivotally mounted on transfer arms 86, and serve to open and close clamps 100 in the same manner as described with respect to actuating cylinders 274 and clamps 272 of U.S. Pat. No. 4,432,186.

Figure 6:
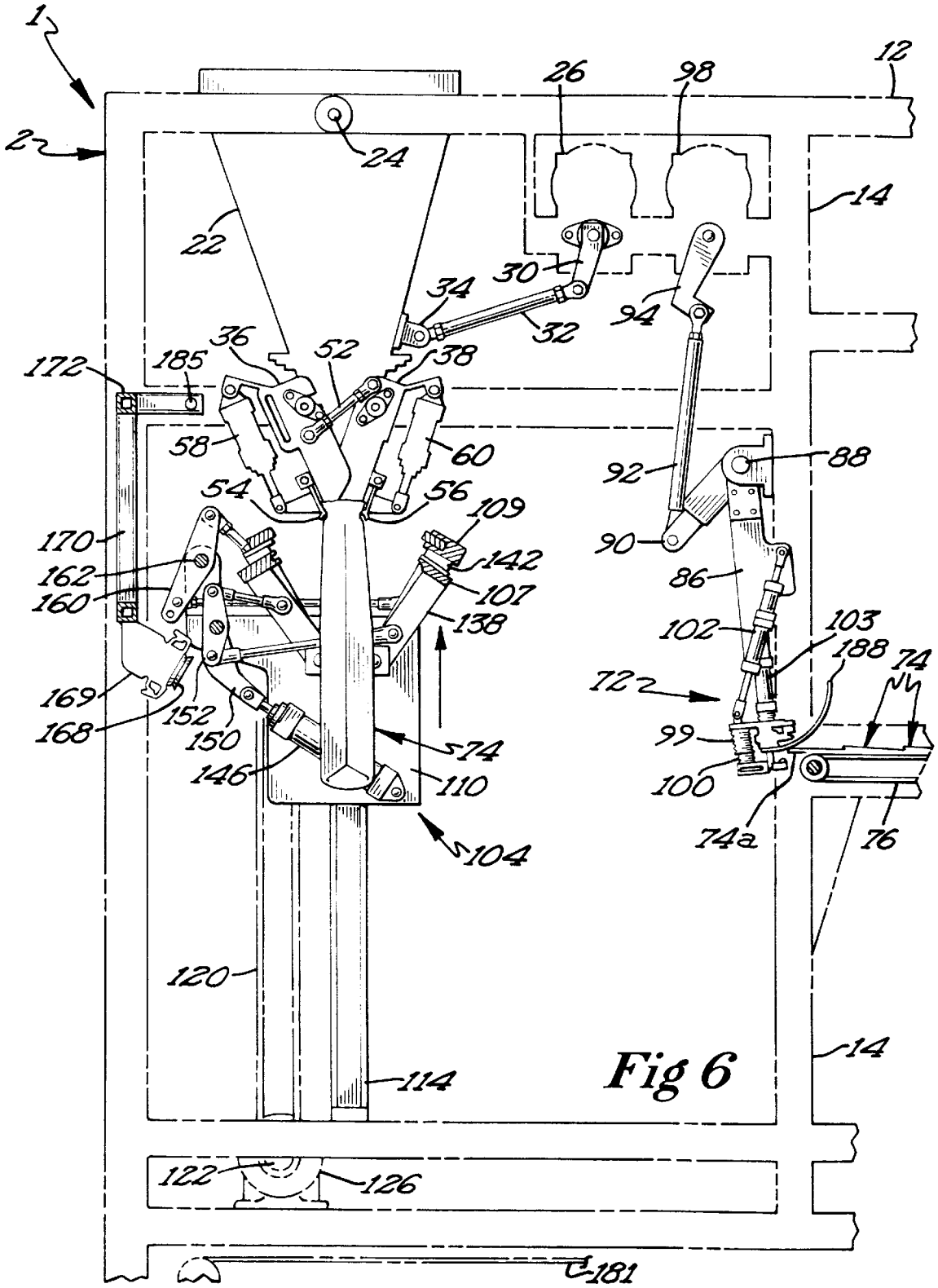
FIGS. 6 and 7 are side elevation views taken the same as FIG. 2, and showing the machine components in sequential, relative positions to which they are moved subsequent to the stage of an operating cycle illustrated in FIG. 5.
Figure 7:
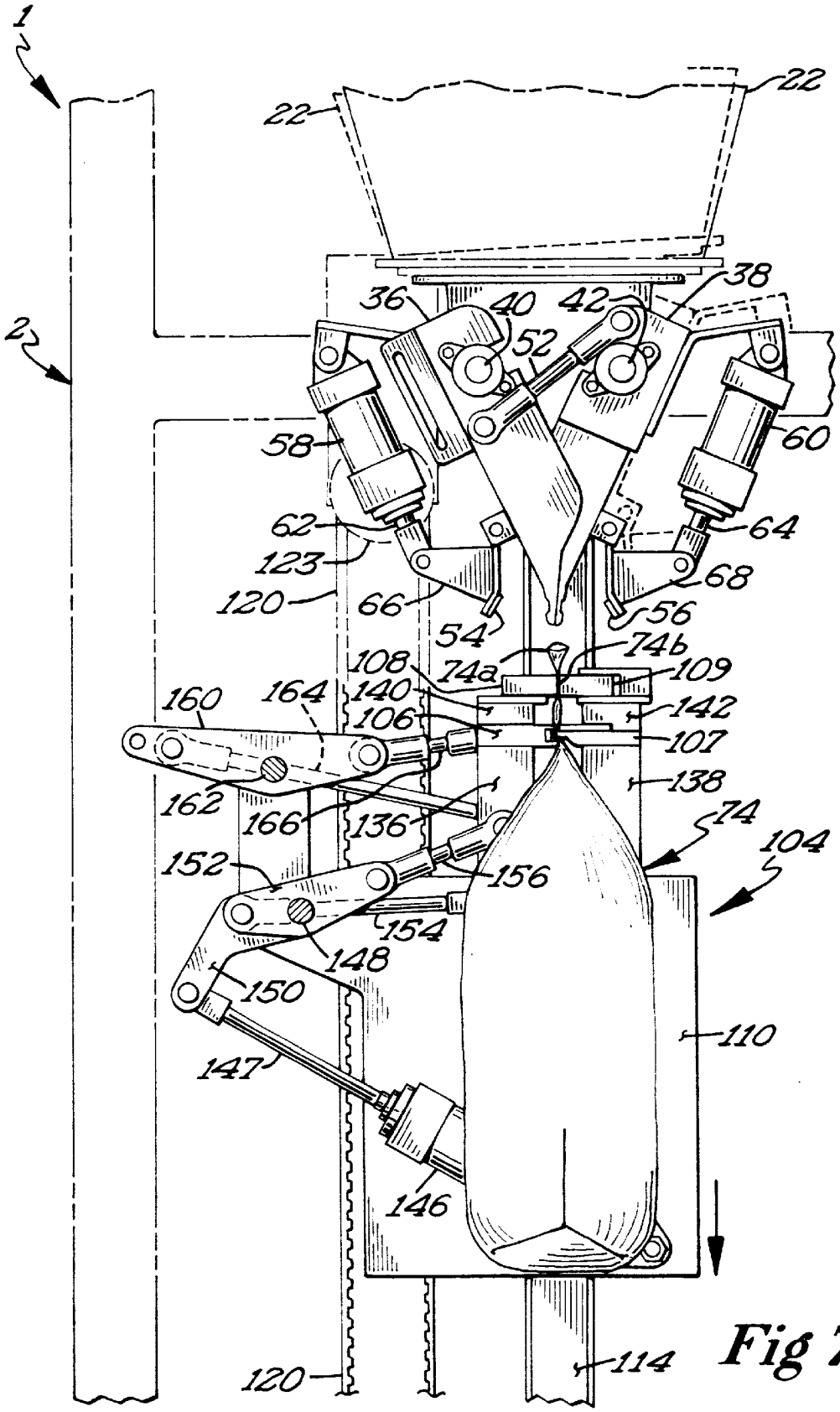

As shown in FIGS. 1 and 2, and on an enlarged, fragmentary view scale in FIG. 7, a carriage generally indicated by reference numeral 104 is utilized to mount a pair of clamping bars 106, 107 and a pair of heat sealing bars 108, 109. For that purpose, carriage 104 is constructed from a pair of opposed mounting plates 110 and 112 although carriage 104 may be movably supported on various types of conveying apparatus for movement either laterally or vertically, a vertically disposed carriage track 114 is preferably provided, for controlled vertical movement of carriage 104 between an elevated, bag clamping position as shown in FIG. 6, and a lowered, bag release position as shown in FIG. 2. As may be shown most clearly with reference to FIG. 3, the carriage 104 is supported for upward and downward movement on V-shaped track 114 by means of two pairs of V-shape guide rollers 116, 118, and 117, 190. Two pairs of such rollers are supported on the outside faces of carriage mounting plates 110 and 112 as indicated in FIGS. 2 and 3. Thus, as indicated most clearly in FIG. 1, there are two carriage tracks 114, 115, one on each side of the carriage, for rolling engagement by; the pairs of rollers 116, 118 and 117, 119, respectively. Rollers 116, 118 engage track 115 on one side of the carriage, and rollers 117, 119 engage track 114, on the opposite side of the carriage.

Raising and lowering movement is imparted to carriage 104 by two pairs of toothed belts 120 and 121, extending vertically on opposite sides of carriage 104. Both belts are of the timing belt type, and extend in continuous, vertically oriented loops. Belt 120 as shown in FIG. 2 is looped about toothed pulleys at its upper and lower ends, only lower pulley 122 being shown in FIG. 2. Similarly, as shown in FIG. 3, endless belt 121 is looped around a top, idler pulley 124, and around a bottom, drive pulley 125. As shown in FIG. 3, a drive motor 126 has its output shaft 128 connected to drive pulley 125. Drive motor 126 has an output shaft 128 which extends horizontally across the front of the machine as illustrated in FIGS. 1, 2, and 3. Bottom, toothed pulleys 122 and 124 are rotatably driven by shaft 128 in order to impart driving power to belts 120 and 121. The end of drive shaft 122, on the opposite side of the frame assembly 2 from motor 126 is rotatably supported in a bearing block 130 as shown in FIG. 3.

Carriage belts 120 and 121 are attached to each of the carriage side plates 110 and 112 by clamping brackets 132 and 133, respectively. The top, idler pulleys 123 (FIG. 7) and 125 for each of the oppositely disposed drive belts 120 and 121 are mounted on idler stub shafts 134 supported from beams of frame assembly 2.

Clamping and forming bars 106, 107 are carried on pivotal arms 136 and 138. As shown most clearly in FIG. 7, bars 106 and 107 have a tongue-in-groove construction, respectively, for tight clamping and bag gripping action against the top of a bag, after it has been filled. In like manner, heat sealing bars 108 and 109 are carried on pivotal arms 140 and 142, both sets of arms being pivotally mounted on carriage side plates 110 and 112. Different types of commonly known heating bar constructions may be utilized for heat sealing the mouths of the plastic bags 74 being filled. In one version, a heat sealing cartridge is mounted on the bar, and mates with grooves or serations formed on the opposite, companion bar. An impulse heat seal may also be utilized, and is the preferred version. Such a heat sealing element comprises a thin flat conductive wire which extends the height of the vertical face of the sealing bar. Depending upon the thickness and composition of the bags being sealed, two such conductive wires may be utilized, one mounted on the vertical face of each of the heating bars. Reference numeral 144 as shown in FIG. 2 generally indicates a heating element carried by bar 109.

Separate sets of operating linkages, each powered by separate power cylinders are utilized to pivot clamping arms 136, 138 and sealing arms 140, 142 between their open positions shown in FIGS. 2–5, and their closed positions shown in FIG. 7. The operating mechanism for clamping arms 136, 138 appears most clearly in FIG. 2. A reversible double acting power cylinder 146 serves to reversibly actuate an over-center linkage mechanism having a transversely extending crankshaft 148 as shown in FIGS. 1 and 2. Power cylinder 146 is pivotally mounted on carriage side plate 110. Its piston is connected through a link 150 with a crank arm 152 mounted on crankshaft 148. A connecting rod 154 extends between crank 152 and oppositely positioned forming and clamping arm 138. A second connecting rod 156 extends from the upper end of crank 152 to adjacent clamping arm 136. As shown in FIG. 2 with the piston of cylinder 146 retracted, the linkage will have moved the clamping arms 136 and 138 apart to their fully open positions. Upon the extension of the piston 147 of cylinder 146, to the position shown in FIG. 7, the aforesaid mechanical linkage will pivot clamping arms 136 and 138 towards each other to the closed, bag engaging and clamping positions shown in FIG. 7. A strong, effective closing and clamping action of clamping bars 106 and 107 is achieved upon the extension of piston 147, as it operates the aforesaid linkage to pull connecting rod 154 to the left as viewed in FIGS. 2 and 7, and to push connecting rod 156 to the right, thereby swinging arms 136 and 138 towards each other to their closed positions as shown in FIG. 7.

In a like manner, a second power cylinder 158 of the double acting type is utilized to operate a similar linkage for moving sealing bar arms 140 and 142 inwardly and outwardly between closed and opened positions. Power cylinder 158 is pivotally attached to carriage mounting plate 112 and is connected to the linkage arrangement as shown in FIGS. 3 and 1. Piston 159 of cylinder 158 is connected to a crank arm 160 mounted on a crank shaft 162. A first connecting rod 164 extends from crank arm 160 to oppositely positioned sealing bar arm 142; and a second connecting rod 166 extends from crank arm 160 to adjacent sealing bar arm 140. With piston 159 of cylinder 158 retracted as shown in FIG. 3, the sealing bar arms 140 and 142 will be moved to the open position as shown. Upon actuation of cylinder 158 and the extension of piston 159, crank arm 160 will be pivoted upwardly to the position shown in FIG. 7, with the result that connecting rod 164 is retracted to pull arm 142 inwardly, and connecting rod 166 at the upper end of crank 160 is moved to the right as viewed in FIGS. 3 and 7 so as to move the second sealing bar arm 140 inwardly to its closed position as shown in FIG. 7. As thus closed against a bag mouth 74*a* as shown in FIG. 7, the heat sealing bars 108 and 109 are in position to carry out a heat sealing operation.

Figure 4:
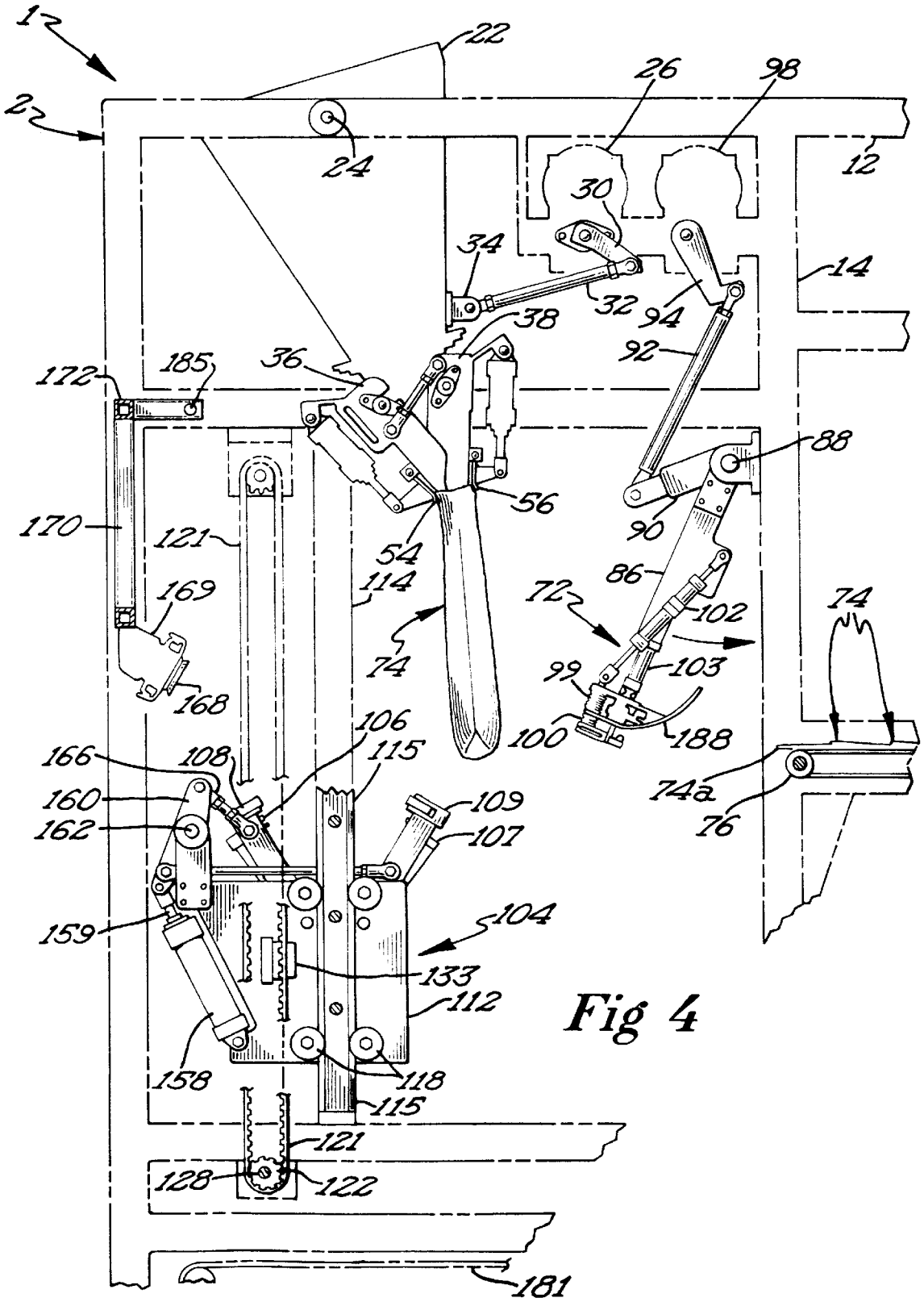
FIGS. 4 and 5 are side elevation views taken the same as FIG. 3, but showing the machine components in sequential, relative positions to which they move at successive stages of an operating cycle of the machine.
Figure 5:
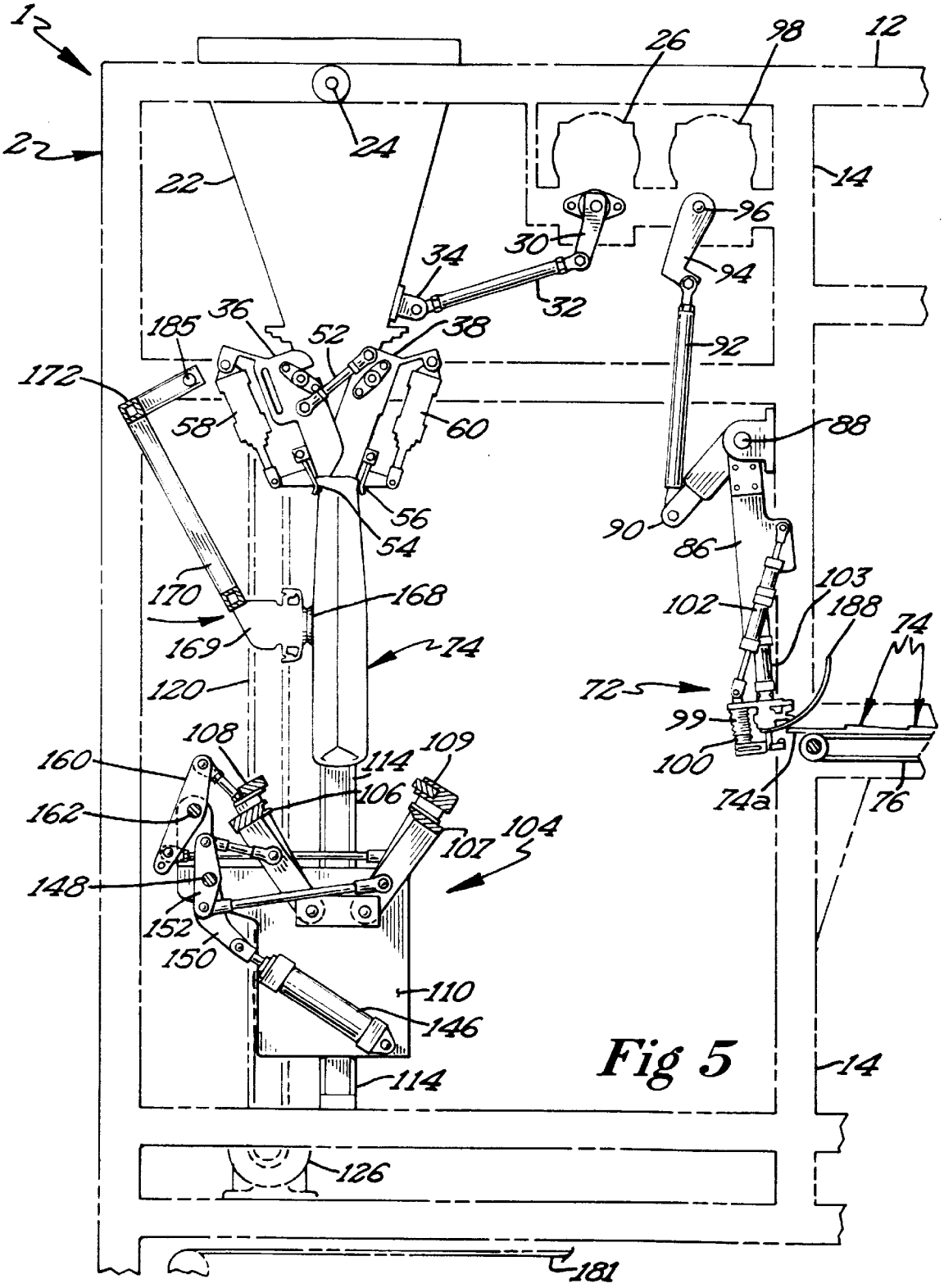

As hereinafter set forth, a filled bag will be swung from the rearwardly pivoted position of spout 22 as shown in FIGS. 3 and 4 to the substantially vertical, second position shown in FIGS. 2 and 6 in which the filling operation is completed and a bag is sealed and released. As a filled bag swings forwardly to the second position with spout 22, its momentum would ordinarily cause it to continue swinging back and forth for a period of time, like a pendulum. Accordingly, in order to stop a filled bag at the desired position of vertical alignment with carriage 104 for clamping and sealing of the bag mouth by bars 106, 107 and 108, 109, respectively, a suction stop device as shown most clearly in FIGS. 1, 2, and 5 is utilized. That device is comprised of a carrying head 169 on which a suction cup 168 is mounted. The head 169 is supported on a pivotal frame 170 of generally rectangular shape as shown in FIG. 1. Frame 170 has a horizontal top frame member 172 which is swingably supported at its opposite ends on pivot bearings 174 and 176. A power cylinder 178 of the double acting type is utilized to swing frame 170, and thus suction cup 168 between a normally retracted, rest position as shown in FIG. 2, and a forwardly swung stop position as shown in FIG. 5. Piston 178 of cylinder 170 is attached to top frame member 172 by a clevis 182. A crank link 184 extending horizontally from top frame member 172 as shown in FIG. 2 is secured on a pivot point connection 185 to the frame assembly. Cylinder 178 is pivotally mounted on the frame assembly by a support bracket 186 as shown in both FIGS. 1 and 2.

A horizontal conveyor 181 as shown in the various figures of the drawing, including FIG. 1, is positioned at the bottom of the frame assembly under carriage 104 to receive filled bags one at a time as the carriage is lowered to its bottom position of FIG. 2. It is to be understood that various types of conveying devices could be utilized to receive filled bags one at a time from the machine 1, and to deliver the bags out of the machine. Also, although the bags are shown, for example in FIG. 2 as having been deposited in an upright position for removal on conveyor 180, guide baffles or contact rods disposed in the path of the bags as they are released from carriage 104 may be utilized to deflect the bags to a horizontal position for removal on conveyor 181, if desired.

The operation of the machine through a complete cycle is fully controlled and automated to selectively position the several operating components, including pivotal spout 22, transfer arm assembly 72, and carriage 104 in optimum, cooperative positions for maximum, high speed handling and filling of bags. The top of each bag is positively gripped and controlled from the supply station 70, through the operation of transfer arm assembly 72 and the filling of bags on spout 22, and the sealing of bags by sealing bars 108 and 109 on carriage 104, and the ultimate delivery of filled bags onto conveyor 181.

Each operating cycle commences with the components in the position shown in FIG. 2. At this point in time, the carriage 104 is at its bottom, rest and bag release position, with clamping arms 136, 138 and sealing bar arms 140 and 142 swung to their open positions. Spout 22 is in the substantially vertically oriented position of FIG. 2, and the transfer arm assembly 72 is substantially in the position as also shown in FIG. 2, with suction clamps 99 and 100 open. A supply of bags 74 is provided, preferably in shingled fashion as shown in FIG. 2, on supply conveyor 76. As noted above, this may be accomplished in various ways. The bag supply apparatus 70 may preferably be of the carousel type as described above with respect to U.S. Pat. No. 4,884,389. The bag pickup arm assembly 190 incorporating a plurality of suction cups is actuated as described in that patent with respect to FIGS. 2–4 to pick up a bag from one of the supply trays 80 of the rotatable carousel plate 78. Such a bag pickup arm assembly is generally indicated by reference numeral 190 in FIG. 1. That arm swings to a bag release position as described in Pat. No. 4,884,389 to drop a bag so that it is guided onto supply conveyor 76. This process is repeated to provide a shingled formation of bags 74 on conveyor 76. A sensor, such as an electric eye (not shown) is positioned to detect the leading edge 74*a* of a bag 74 positioned at the delivery end of conveyor 76 as shown in FIG. 2 for pickup by transfer arm assembly 72. When the sensor provides a signal that a bag 74 is in such a position for pickup, a machine cycle begins. Transfer arms 86 of the arm assembly 72 swing slightly towards conveyor 76 from the position shown in FIG. 2, and cylinders 102 and 103 are actuated to pivot suction clamps 99 and 100 to their closed, bag gripping position. It is to be noted that a servomechanism, in conjunction with a computer program, is utilized to coordinate the movement of the various components of the system as described.

After gripping the leading edge 74*a* of a bag 74, suction clamps 99 and 100 are swung upwardly on arms 86, by the sequential actuation of fluid motor 98. The output shaft 96 of that motor is rotated so as to cause crank 94 to rotate clockwise to the raised position shown in FIG. 3. This serves to swing transfer arms 86 upwardly to the position shown in phantom lines in FIG. 3. Simultaneously, fluid motor 26 is actuated to rotate crank 30 counterclockwise to the position shown in FIG. 3. This serves to swing spout 22 about its pivot axis 24 to a first, bag receiving position as shown in FIG. 3. With spout 22 so positioned, the servomechanism functions to actuate fluid motor 98 so as to further rotate crank 94 and swing transfer arms 86 to the upper end of their bag hanging path as shown in solid lines in FIG. 3. At this point in time, the clam shells 36, 38 of spout 22 are closed, and spout clamps 54 and 56 are in their open positions as shown in FIG. 3. Arms 86 accurately place the bag mouth 74*a* on the spout 22 as shown in FIG. 3, and cylinders 58 and 60 are actuated to pivot clamps 54 and 56 to their closed, bag clamping positions as shown in FIG. 4.

With a bag 74 thus securely clamped on spout 22, cylinders 102 and 103 are actuated to move suction clamps 99 and 100 to their open positions, after which the transfer arm assembly 72 swings back downwardly towards conveyor 76 as indicated in FIG. 4. Transfer arms 86 are returned to their position as shown in FIG. 2 to pick up the next empty bag from conveyor 76, upon again receiving a signal from a sensor that the leading edge 74*a* of a bag is again in position for grasping by suction clamps 99 and 100.

When the sensing eye detects the absence of the leading edge of a bag at the forward end of conveyor 76, the conveyor 76 is indexed forward and stops. The bag supply apparatus 70 is then again actuated to pick up a bag and drop it onto conveyor 76. Thus, conveyor 76 is intermittently indexed forward in coordination with the grasping of the lead bag by the transfer arms 86 of transfer arm assembly 72.

When carriage 104 has moved downwardly with the previously filled bag to a position below the bottom of the next, empty bag hanging on spout 22, cylinder 178 is actuated to pivot frame 170 to the position shown in FIG. 5. This locates suction stop 168 as shown in FIG. 5. Substantially simultaneously, fluid motor 26 is actuated to swing spout 22 forwardly, or to the left as viewed in FIGS. 4 and 5, to the second, bag sealing and release position as shown in FIG. 5. The filling of the bag is completed as spout 22 swings to that second, forward position wherein it is substantially vertically oriented. Vacuum delivered through suction head 169 causes suction cup 168 to adhere to the face of the bag side wall for a fraction of a second. This stops the forward, swinging movement of a filled bag 74 substantially in the position as shown in FIG. 5. As thus located, the filled bag is substantially centered over carriage 104 in position to be engaged by the clamping bars 106, 107 and sealing bars 108, 109. The filled bag having thus been stabilized in the desired vertically hanging position, cylinder 178 is again actuated to retract its piston 180, and thereby swing the suction cup frame assembly 170 back to its normal, rest position of FIG. 2, out of the vertical path of carriage 104. At this point in the cycle, the filling of a bag 74 has been completed, and cylinder 44 is again actuated to move the clam jaws 36 and 38 to a fully closed position.

Next, the servomechanism or other control device actuates drive motor 126. The rotation of drive shaft 128 serves to revolve carriage lift belts 120 and 121 so as to raise carriage 104 upwardly to the position shown in FIG. 6, with the clamping and forming bars open. Cylinder 146 is then actuated to rotate crank shaft 148 and to thus pivot clamping bar arms 136 and 138 inwardly to the position shown in phantom lines in FIG. 6, in clamping engagement with the opposite sides of bag mouth 74*a*. This event serves to trigger the actuation of cylinders 58 and 60 so as to swing spout clamps 54 and 56 to their open, bag releasing positions as shown in FIG. 7.

The servomechanism thereafter again actuates drive motor 126 in a reverse direction so as to revolve belts 120 and 121 in a direction so as to lower carriage 104. This is done in order to clear the top area 74*b* of the bag mouth to be sealed from the bottom end of spout 122. When this is accomplished by the lowering of carriage 104 to the position shown in FIG. 7, power cylinder 158 is actuated. The extension of piston 159 of cylinder 158 serves to rotate crank 160 on crankshaft 162 so as to swing sealing bar arms 140 and 142 inwardly against the opposite sides of the bag face, in a closed position as shown in FIG. 7. It is to be noted that arms 140 and 142 are constructed and arranged so as to bring sealing bars 108 and 109 to a bag sealing position as shown in FIG. 7, above clamping bars 106 and 107. By virtue of this arrangement, the full weight of the bag is held by clamping bars 106 and 107, engaged as shown in FIG. 7 in a tongue-in-groove arrangement. Thus, there is no downward weight acting on sealing bars 108, 109 which might otherwise cause the bag mouth to tear during the heat sealing operation. The closing movement of heat sealing arms 140 and 142 is initiated upon a predetermined downward travel of carriage 104. At that time, the sealing apparatus heating element or elements are energized to carry out the sealing of the mouth of the bag in the area 74*b*, that operation being shown in FIG. 7.

After a predetermined dwell time has elapsed, the sealing apparatus is deenergized, and a fraction of a second cooling time is allowed. It is noteworthy that the sealing of the bag mouth and the subsequent cooling of the heating bars 108 and 109 take place very rapidly during the downward travel of carriage 104. As carriage 104 continues to travel downwardly, and after the cooling time has elapsed, cylinder 158 is again actuated to retract its piston 159, and thus to swing arms 140 and 142 to the fully open position of heating bars 108 and 109 as shown in FIG. 2. This will normally be accomplished before carriage 104 reaches the lower extremity of its travel. When carriage 104 does reach that lowermost, rest position as shown in FIG. 2, drive motor 126 is deactivated and clamping bar cylinder 146 is actuated to retract its piston 147. With this operation, clamping arms 136 and 138 are swung to the open position shown in FIG. 2, and a filled bag is released to drop down onto conveyor 181. Successively dropped, filled bags are carried away by conveyor 181 as illustrated in FIGS. 2 and 3.

In the course of the foregoing sequence of operations, fluid motor 26 is actuated to start pulling spout 22 back to the rearwardly swung, bag receiving position of FIG. 3 the instant that carriage 104 has been lowered far enough for the spout 22 and its clamping jaws 36 and 38 to clear the filled bag and the apparatus of carriage 104. Operating cycle time to fill each bag is thus reduced by swinging spout 22 rearwardly to its bag receiving position and commencing the filling of the next bag, while the preceding, filled bag is being lowered by carriage 104, sealed and dropped onto delivery conveyor 181. The intermediate position of spout 22, wherein it has started to swing rearwardly just as a filled bag has cleared clam shells 36 and 38 is indicated in phantom line in FIG. 7. After a filled bag has been deposited on conveyor 181, with carriage 104 at the bottom of its travel path as shown in FIG. 2, the carriage 104 is ready to move up to clamp and seal the next bag.

In order to assist in guiding bags 74 as they are gripped by suction clamps 99 and 100 of transfer arm assembly 72, as shown in FIG. 2, a curved guide baffle 188 may be secured to the clamping head of transfer arms 86. Thus, as shown in FIGS. 3 and 4, guide baffle 188 moves with arms 86, and also assists in holding a bag in the desired position as it is swung by arms 86 up into engagement with clamping jaws 36 and 38 of spout 22.

It is also contemplated that special, gusset forming and holding clamps and fingers may be utilized, if the apparatus of machine 1 is utilized for handling, filling, and sealing gusseted bags. For that purpose, gusset forming fingers and clamps as disclosed at 92–98 in U.S. Pat. No. 4,432,186 may be utilized. Power cylinders 192 for actuating such gusset forming and clamping members may be provided as shown in FIG. 1. Those cylinders operate linkage rods 194, which are connected to fingers or rods 196, as shown in FIG. 1, for insertion inside of the gusset pleats of a bag. Such gusset gripping and forming devices may be used in conjunction with spout clamps 54 and 56 to form the bag gussets while the bag is fully opened on the spout 22.

It is contemplated that various changes may be made in the size, shape, and operation of the machine components disclosed herein, without departing from the spirit and scope of the invention as defined by the following claims.

What is claimed is:

1. Apparatus for filling and sealing bags comprising:

a material dispensing spout having a discharge end defined by closure members operable between closed and open positions for discharging particulate material into a bag;

a first power actuator positioned and arranged to open and close the spout discharge end closure members;

clamping members on the spout discharge end movable between a closed position in clamping engagement with a bag mouth on the spout discharge end and an open position;

a carriage movable in a travel path between a first, bag receiving position in close proximity to the spout discharge end and a second, bag discharge position away from the spout;

sealing apparatus mounted on the carriage and movable between a first, inoperative position and a second position in sealing juxtaposition with a bag mouth, whereby bags may be clamped on the spout and filled one at a time, and thereafter released by the spout clamping members for movement by the carriage to a release position, with the bag mouth being sealed by the sealing apparatus as the carriage moves between its first and second positions.

2. Bag filling and sealing apparatus as defined in claim 1 wherein:

said sealing apparatus comprises a heat sealer having a pair of elongated, pivotal bars movable towards and away from each other between said first, inoperative position wherein said bars are open and said second position wherein the bars are closed in sealing engagement with a bag mouth.

3. Bag filling and sealing apparatus as defined in claim 1 wherein:

said spout is movable between a first, bag receiving position wherein said clamping members clamp an empty bag onto the spout discharge end, and a second, bag release position in cooperative juxtaposition to the carriage for bag transfer to the carriage and sealing by said sealing apparatus.

4. Bag filling and sealing apparatus as defined in claim 3 wherein:

bag clamping apparatus is mounted on the carriage, said clamping apparatus being movable between a first, open position, and a second, closed position in clamping engagement with the opposite faces of a bag mouth.

5. Bag filling and sealing apparatus as defined in claim 4 wherein:

said clamping apparatus comprises a pair of elongated, clamping bars movable between said first and second positions.

6. Apparatus as defined in claim 4 wherein:

the sealing apparatus is positioned on the carriage at an elevation above the clamping apparatus, whereby a filled bag may be gripped and held by the clamping apparatus, while the bag is still on the spout, and thereafter removed from the spout by the carriage after the clamping members on the spout are moved to their open position, with the clamping apparatus supporting the weight of the filled bag below the area on the bag mouth to be sealed by the sealing apparatus.

7. Bag filling and sealing apparatus as defined in claim 6 wherein:

the sealing apparatus comprises a heat sealer having a pair of elongated, pivotal bars movable towards and away from each other between said first, inoperative position wherein said bars are open and said second position wherein the bars are closed in heat sealing engagement with a bag mouth.

8. Bag filling and sealing apparatus as defined in claim 1 wherein:

bag clamping apparatus is mounted on the carriage, said clamping apparatus being movable between a first, open position, and a second, closed position in clamping engagement with the opposite faces of a bag mouth.

9. Bag filling and sealing apparatus as defined in claim 3 wherein:

the spout is pivotally supported and is swingably movable between said first and second positions.

10. Bag filling and sealing apparatus as defined in claim 3, and further comprising:

bag supply apparatus constructed and arranged to deliver bags one at a time to a bag pickup position; and bag transfer apparatus having bag clamping devices thereon, said bag transfer apparatus being movable from the bag pickup position to a second position in proximity to the spout when the spout is in its bag receiving position to place a bag on the spout for clamping engagement by the clamping members on the spout.

11. Bag filling and sealing apparatus as defined in claim 3 and further comprising:

a stop device movable between a first position out of the travel path of the carriage and a second position to engage a filled bag held on the spout by the spout clamping members as the spout moves to its second, bag release position, to thereby stop the movement of the bag and stabilize the bag in the travel path of the carriage.

12. Bag filling and sealing apparatus as defined in claim 11 wherein:

said stop device comprises a suction cup operative to grasp a bag and thereby stabilize a filled bag in the travel path of the carriage.

13. Bag filling and sealing apparatus as defined in claim 3 wherein:

the carriage is movable in a substantially vertical path between said first bag receiving position wherein the carriage is elevated and said second, bag release position wherein the carriage is at the bottom end of its vertical path of travel.

14. Bag filling and sealing apparatus as defined in claim 13 wherein:

the spout is substantially vertically disposed in alignment with the carriage when the spout is in its second, bag release position.

15. A method of filling and sealing bags with particulate material on a machine having a material discharge spout with a discharge end which may be opened and closed, and bag clamping members on the spout movable between a closed position in clamping engagement with a bag to be filled and an open position, and a movable carriage supporting sealing apparatus movable between a first, inoperative position and a second position in sealing juxtaposition with a bag mouth, comprising the steps of:

clamping an empty bag on the spout discharge end with said bag clamping members;

opening the spout discharge end to fill the bag with particulate material;

closing the spout discharge end;

moving the carriage under the filled bag in close proximity to the spout;

moving the bag clamping members on the spout to their open position to release the filled bag to the carriage;

moving the sealing apparatus to its second position in sealing engagement with the bag mouth and actuating the sealing apparatus to seal the bag mouth;

moving the carriage away from the spout; and discharging the filled and sealed bag from the carriage.

16. The method as defined in claim 15 wherein:

the carriage is moved in a travel path between a first, filled, bag receiving position in said close proximity to the spout discharge end and a second, bag discharge position, and the sealing apparatus is moved to said second position and actuated to seal the mouth of a bag after the carriage has moved away from the spout and during the travel of the carriage from its first position to its second position.

17. The method as defined in claim 16 wherein:

bag clamping apparatus is mounted on the carriage and is actuated to clamp and grip the upper end of a filled bag while it is still held on the spout; and thereafter moving the spout bag clamping members to their open position;

moving the carriage away from the spout; and then moving the sealing apparatus to its second position in sealing juxtaposition with the bag mouth at a location on the bag mouth above the location where the bag is gripped by the bag clamping apparatus on the carriage.

18. The method as defined in claim 15 wherein the spout is movable and comprising:

moving the spout to a first, bag receiving position wherein an empty bag is clamped on the spout;

opening the spout discharge end to commence filling a bag while the spout is in said first, bag receiving position; and thereafter moving the spout to a second, bag release position in cooperative juxtaposition to the carriage for bag transfer to the carriage.

19. The method as defined in claim 18 wherein:

the spout is moved towards its first, bag receiving position as the carriage moves away from the spout towards a filled bag discharge position.

* * * * *